US005860527A

United States Patent [19]

Frankenberg et al.

[11] Patent Number: 5,860,527

[45] Date of Patent: Jan. 19, 1999

[54] PLASTIC TOTE BOX IMPROVEMENTS

[75] Inventors: Jason R. Frankenberg; Randall H. Hafemeister, both of Watertown, Wis.

[73] Assignee: Menasha Corporation, Neenah, Wis.

[21] Appl. No.: 740,115

[22] Filed: Oct. 18, 1996

[51] Int. Cl.[6] ..... B65D 21/04

[52] U.S. Cl. ..... 206/509; 206/511

[58] Field of Search ..... 206/507, 509, 206/511

[56] References Cited

U.S. PATENT DOCUMENTS

| | | | |
|---|---|---|---|
| 2,823,828 | 2/1958 | Frater | 220/97 |
| 4,000,817 | 1/1977 | Sanders et al. | 206/507 |
| 4,189,052 | 2/1980 | Carroll et al. | 206/507 |
| 4,372,444 | 2/1983 | Le Grand et al. | 206/505 |
| 4,520,928 | 6/1985 | Wilson | 206/507 |
| 4,523,681 | 6/1985 | Kreeger | 206/507 |
| 4,982,844 | 1/1991 | Madan et al. | 206/507 |
| 5,035,326 | 7/1991 | Stahl | 206/507 |
| 5,582,296 | 12/1996 | Beauchamp et al. | 206/507 |

*Primary Examiner*—Joseph M. Moy

*Attorney, Agent, or Firm*—Quarles & Brady

[57] ABSTRACT

A 180° stackable, nestable plastic tote box has ledge supports and foot supports with a combination of vertical and angled surfaces for guiding an upper box relative to a lower box to a stacked position and resisting the tendency of the upper box to collapse into the lower box when it is heavily loaded. The box also has orientation buttons received in recesses at its rim which give the box an easily visible asymmetric appearance. A drainage collector is molded into each box end wall which underlies a lid of the box and collects drainage from the lid to channel the drainage to the outside of the box, and is formed in walls which help support an upper box on a lower box when it is laterally slid onto it for stacking. The box can be provided with a one-piece lid or a two-piece hinged lid. The one-piece lid has wedge structures depending downwardly from its rim which snap into holes in the top of the box. A padlock hole is formed in an angled wall at the end of the box for locking the lid shut. A piano-type hinge of the two-piece lid has tabs which extend into holes in the box when the lid is shut so as to prevent lateral disengagement of the box side wall from the lid. The box rim also has upstanding wall structures which confront wall structures molded into the lid to resist lateral separation of the hinge joint when the lid is closed.

8 Claims, 14 Drawing Sheets

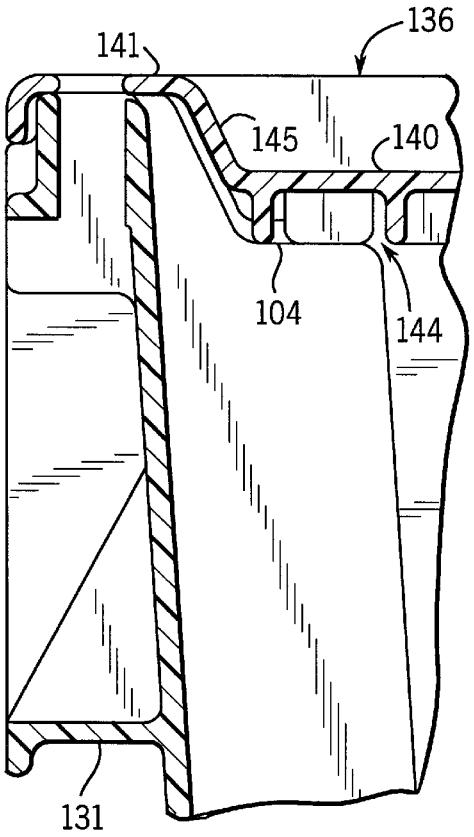
FIG. 22
FIG. 23
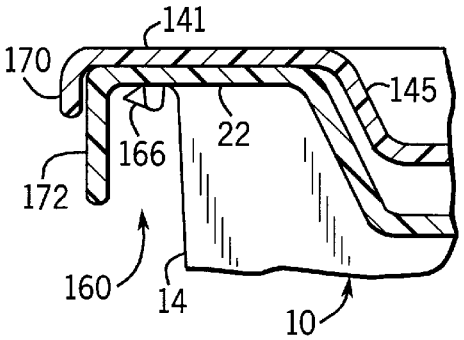
FIG. 24
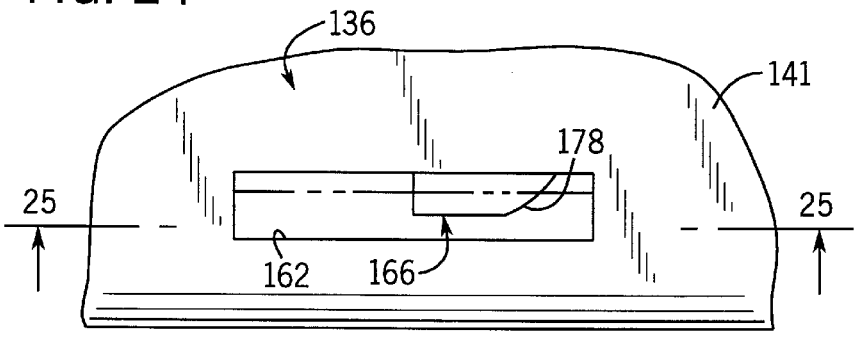
FIG. 25
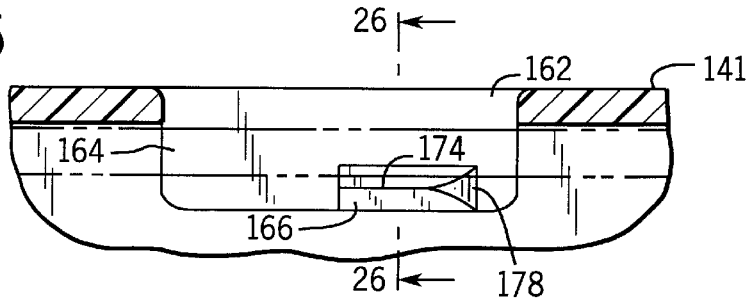

FIG. 26
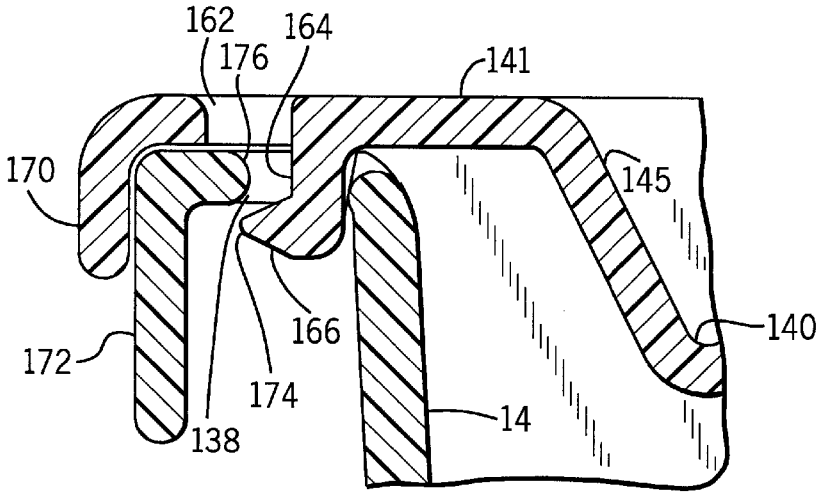
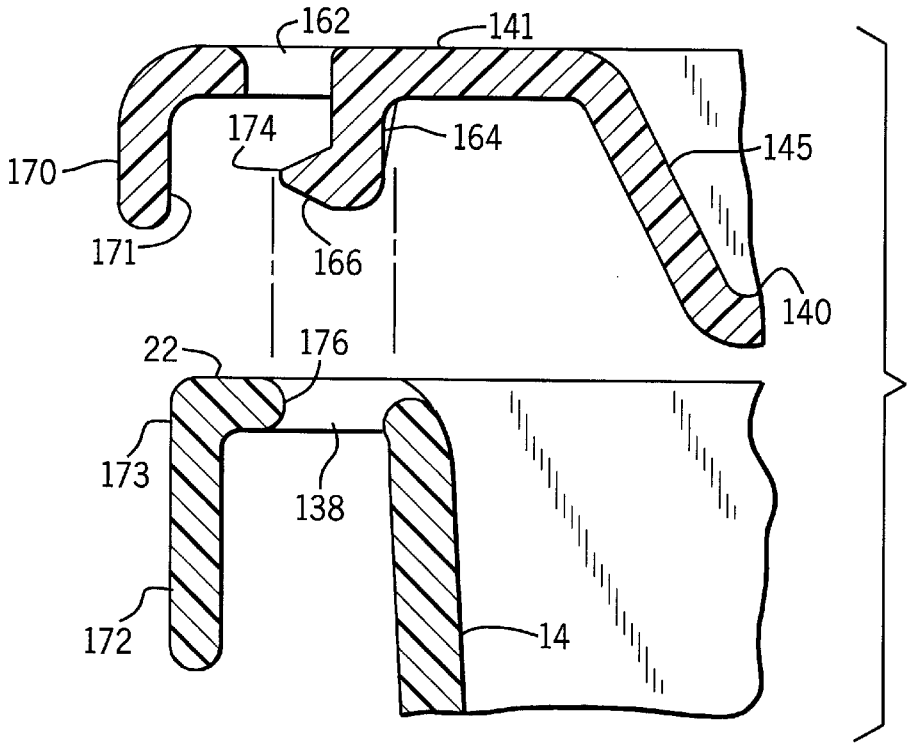
FIG. 27

PLASTIC TOTE BOX IMPROVEMENTS

BACKGROUND OF THE INVENTION

1. Field of the Invention

This invention relates to improvements in plastic tote boxes, and in particular to a tote box having improved stackability, drainage, and security.

2. Discussion of the Prior Art

Plastic tote boxes have been known for a number of years and have found wide spread usage in commercial and residential applications. Such boxes have been available having no lids, with one-piece lids which enclose the entire top of the box, or with two-piece lids, each piece of which is hinged along one side of the tote box and in which the pieces meet along a line of closure generally in the middle of the box top. These boxes are used for storing and transporting parts or other items and are reusable. The boxes and their lids are also typically made of plastic materials which are recyclable.

Such tote boxes which are both stackable and nestable are known in the industry as 180° stack and nest boxes. With this type of box, in one orientation of an upper box relative to a lower box, the upper box has foot supports which are supported by ledge supports of the lower box near the top of the lower box, so that boxes containing items can be stacked with the lower boxes supporting the weight of the upper boxes. When the boxes are emptied as for example occurs when the parts are used in production, the boxes are prepared for return shipment or storage by nesting them together by turning the upper box from its stacked orientation 180°, in which orientation the upper box nests inside of the lower box, which conserves vertical space.

Particularly in industrial applications, plastic tote boxes can be used to carry heavy items and also are subjected to generally rough usage. When heavy items are loaded into a plastic tote box, distortion of the box inevitably occurs, particularly when a stacked box is only supported by its foot portions, typically at the ends of the box. The weight inside the box bows it inwardly and the forces transmitted from the foot supports of the upper box to the ledge supports of the lower box tend to push the end walls of the lower box outwardly so that the foot supports can slip off of the ledge supports, and the upper box falls down into the lower box. Consequently, this has limited the amount of weight which could be put into a box which was being stacked and also the total height and weight of the stack.

During shipment and storage, boxes of the type described, individually and in stacks, are also subjected to moisture, such as rain, condensation, accidental or intentional spraying, or leakage from an upper box to a lower box. If this moisture is permitted to enter the box, it can sometimes damage or ruin the items contained in the box. It is, therefore, desirable that moisture falling or collected on the box be directed away from the interior of the box.

Tote boxes of the type described are also expected to provide some level of security. Typically, a hole is provided near the top edge of the box through which a padlock can be inserted to lock a lid of the box closed. Because of the permitted size of the rim of the box and the configuration of the lid, the size of the hole has been limited, such that only a relatively small diameter shank of a padlock could be inserted through the hole, or making it difficult to insert the shank of a padlock through the hole. In addition, since the padlocks are usually provided only at the top midpoint of one or both end walls of the box, if the lid is not connected to the box along the side walls with a secure connection, access to the interior of the box can be gained by separating the lid from the box along the sides, which permits pilfering.

Also, in 180° stack and nest containers, it is helpful to the person stacking or nesting them if the container has some obvious indication of its orientation, since its orientation determines whether it is in the stack position or the nest position relative to the lower container. Such an indication should be easily visible without additional effort from any angle from which a box is normally handled.

SUMMARY OF THE INVENTION

The invention provides a stackable plastic tote box of the type described having ledge supports for supporting foot supports of an upper box in a stack of the boxes in which the ledge supports and foot supports each have laterally extending, confronting angled and vertical surfaces, the angled and vertical surfaces of each foot support facing inwardly and the angled and vertical surfaces of each ledge support facing outwardly. The confronting angled and vertical surfaces resists collapse of a heavily loaded stacked container inside of the lower container, and also help guide the foot supports into engagement with the ledge supports when stacking containers.

To further improve guidance when stacking, an inwardly facing angled surface is preferably formed on the ledge support opposite from the outwardly facing vertical and angled surfaces. To make the stacked containers even more resistant to collapse, the supports can be provided with confronting vertical surfaces which extend longitudinally, for example at each end of laterally extending confronting vertical surfaces.

In another useful aspect, the supports are arranged differently from one end of the box to the other such that in a first orientation of the upper box relative to the lower box the boxes stack, and in a second orientation 180° to the first orientation the boxes nest. In this aspect, at one end of the box, the ledge supports may be joined by a support surface at approximately the same level as the ledge supports and at the opposite end of the box a support surface is provided between and spaced inwardly from the ledge supports. These support surfaces help support an upper box as it is slid laterally onto a lower box when the boxes are stacked.

In another aspect of the invention, in a 180° stackable nestable box, a recess is formed in a top edge of the box nearer to one end of the box than to an opposite end of the box, the recess being open on top, inside, and outside of the edge. A button is received in the recess which is visible from the top, inside, and outside of the edge, such that the button gives the box an asymmetrical appearance. Thus, a person stacking or nesting the boxes can readily observe the orientation of the box beneath and properly orient the box to be placed on top. In this aspect, a second recess and button is preferably provided in the top edge of the box, the recesses and buttons being provided in longitudinal sides of the box and at longitudinal positions which are opposite from one another, to make it easier to tell one orientation from another.

In another aspect of the invention, in plastic tote boxes of the type having a lid supported on an upper edge of the box for covering the box, a drainage collector is provided inside the box below the lid. The drainage collector has at least one hole in a bottom thereof to direct fluid in the collector outside of the box. The lid also has at least one hole which provides a flow path from a top surface of the lid to the drainage collector. Thereby drainage or moisture which collects on top of lids of the boxes is directed outside of the boxes, to run down the outside of the box or stack and not into it.

In this aspect, the lid may be one or two piece. If two piece, each piece is preferably hinged along a top edge of one of the sides of the lid and the pieces close along a line of closure when the lid is shut. Each piece is preferably provided with a fluid flow channel which is open to the top of the lid when the lid is shut. The channel collects fluid from the lid and directs the fluid to the drainage collector, and has walls which prevent the fluid from flowing over them into the interior of the box.

In a plastic tote box of the type which is provided with four generally vertical sides and a lid for covering an open top of the box, the lid and end walls of the box being provided with a lock hole through which a shank of a padlock can be placed to lock the lid to the box, the improvement wherein the lock hole in the box is formed in a wall of the box which is angled at a steeper angle from vertical than a draft angle of surrounding walls of the box.

In a preferred form of a plastic tote box which is closed by a one-piece lid which attaches to the box, the box is provided with an upper rim and the lid is provided with an upper edge which rests on the upper rim of the box. The upper edge of the lid has a peripheral downwardly depending flange which confronts an outer edge of the rim of the box in close proximity, and the rim of the lid has downwardly depending wedge structures spaced inwardly from the flange by a certain lateral distance and facing the flange. The rim of the box is provided with holes at positions corresponding to positions of the wedge structures, and each hole has an outer undercut edge so that the wedge structures can be inserted into the holes and hooked under the undercut edge. The lateral dimension of the rim of the box between the outer edge of the hole and the outer edge of the rim is approximately equal to or greater than the lateral distance from the wedge structure to the peripheral flange so as to provide positive engagement, with the wedge structure resiliently flexing to enter and exit the hole.

In this aspect, each wedge structure preferably has upper and lower angled surfaces and each has at least one end which tapers laterally inwardly, to facilitate engagement and disengagement from the hole. If the wedge structures are provided with a tapered end, the tapered ends are all preferably directed away from the longitudinal center of the lid.

In another useful aspect of a plastic tote box of the type having a two-piece piano-hinged lid, one or more hinge pin supports is provided with a downwardly depending tab and the top rim of the box along each hinge is provided with a hole to receive the tab when the lid is closed. The tab extends into the hole so as to abut an edge of the hole if the rim is attempted to be laterally separated from the lid. In this form, the tabs and holes are preferably provided in longitudinal center regions of the lid pieces and the box. To further resist lateral separation of the box side walls from the lid along the hinge, the upper rim of the box can be formed with laterally extending inwardly facing walls and the lid pieces with walls which confront the box walls when the lid is closed.

Other objects and advantages of the invention will be apparent from the drawings and detailed description.

BRIEF DESCRIPTION OF THE DRAWINGS

FIG. 22 is a cross-sectional view from the plane of the line 22—22 of FIG. 18;

FIG. 23 is a cross-sectional view from the plane of the line 23—23 of FIG. 18;

FIG. 24 is a detail view of the portion of FIG. 18 indicated by arc 24—24;

FIG. 25 is a cross-sectional view from the plane of the line 25—25 of FIG. 24;

FIG. 26 is a cross-sectional view from the plane of the line 26—26 of FIG. 25;

FIG. 27 is a view similar to FIG. 26 but with the lid disengaged from the box;

BRIEF DESCRIPTION OF THE PREFERRED EMBODIMENTS

Figure 1:
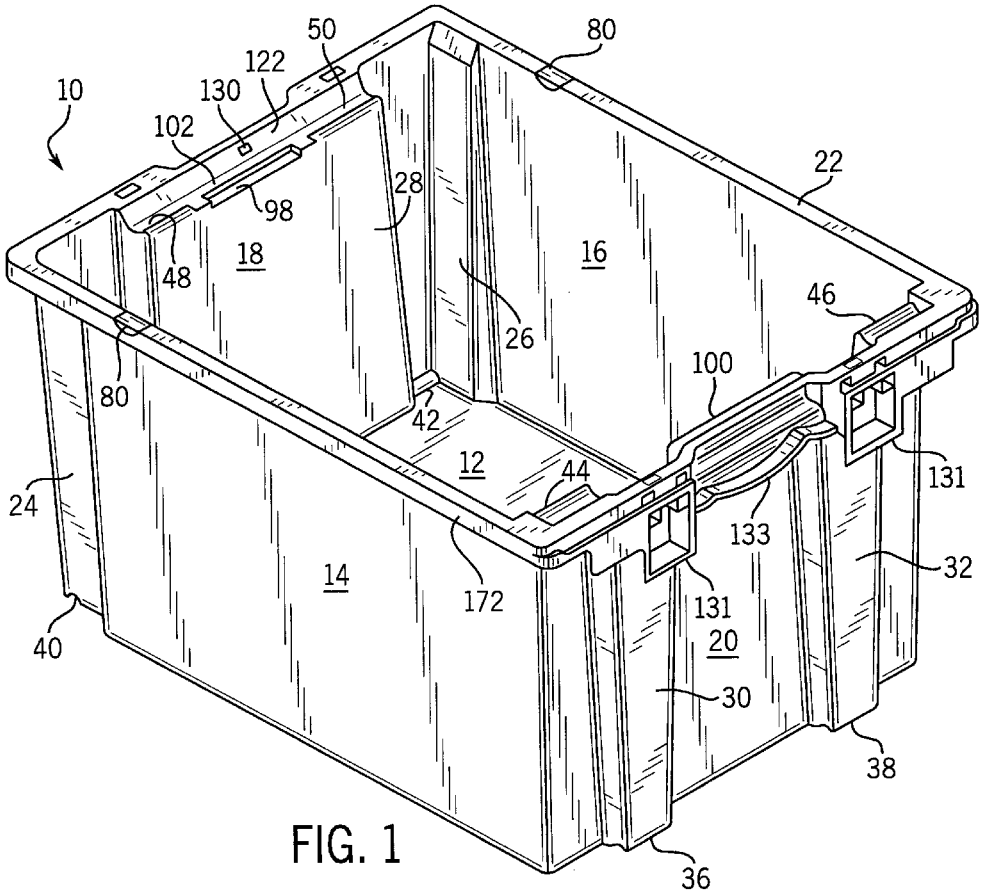
FIG. 1 is a perspective view of a tote box incorporating the invention.

FIG. 1 illustrates a tote box 10 of the present invention. The tote box 10 is molded plastic, for example high-density polyethylene, and has a bottom 12, longitudinally extending sides 14 and 16 and laterally extending end walls 18 and 20. At the top of the side and end walls, a rim 22 encircles the top of the box 10. The side walls 14 and 16 are indented at their ends adjacent to end wall 18 at 24 and 26, the end wall 18 is indented at 28, which is positioned inward of the lateral ends of the wall 18, and the end wall 20 is extended at 30 and 32.

Figure 2:
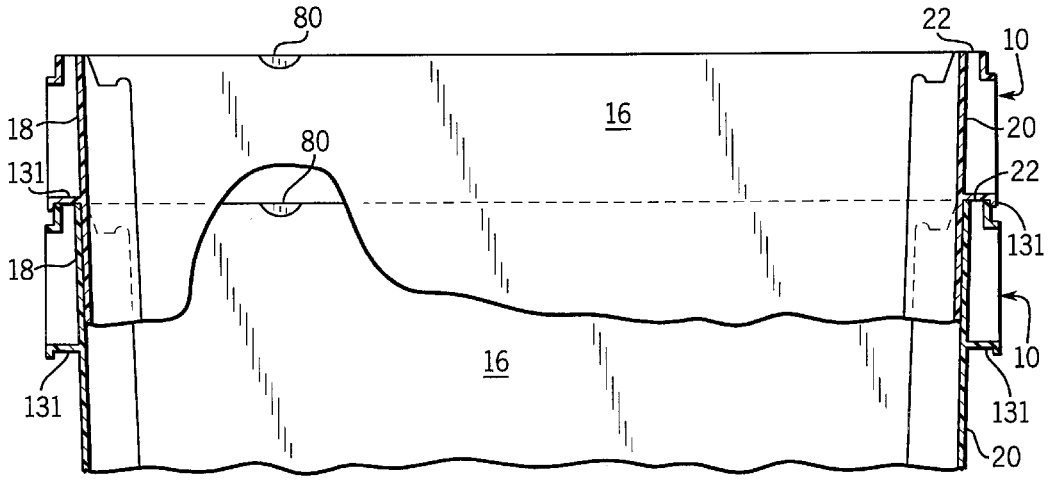
FIG. 2 is a partial longitudinal sectional view of two tote boxes of the type illustrated in FIG. 1 nested together.
Figure 3:
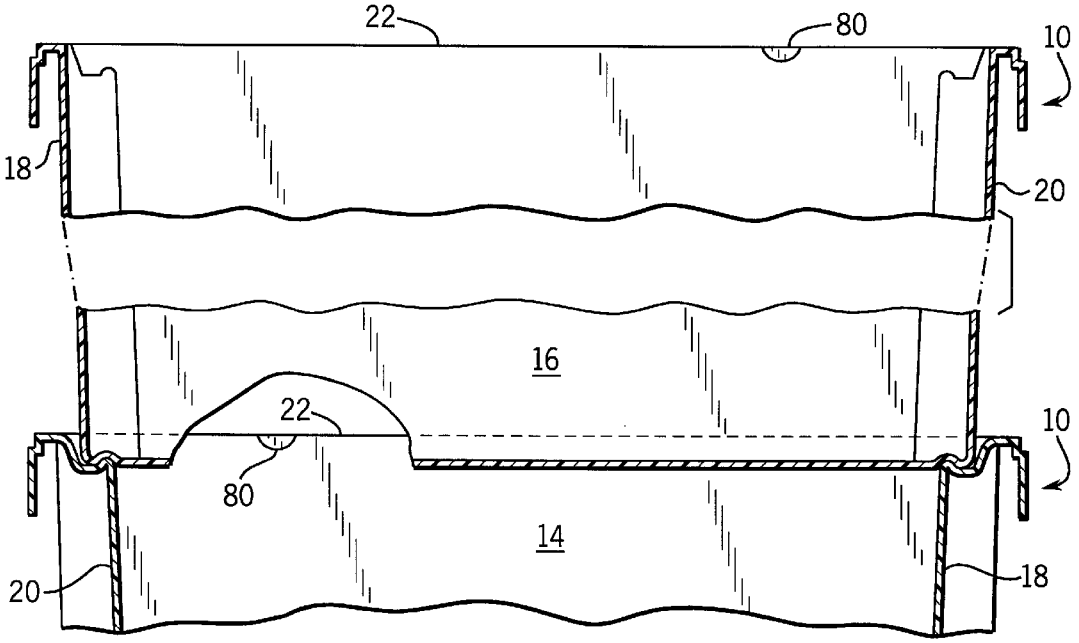
FIG. 3 is a longitudinal sectional view of two boxes of the type illustrated in FIG. 1 stacked.
Figure 4:
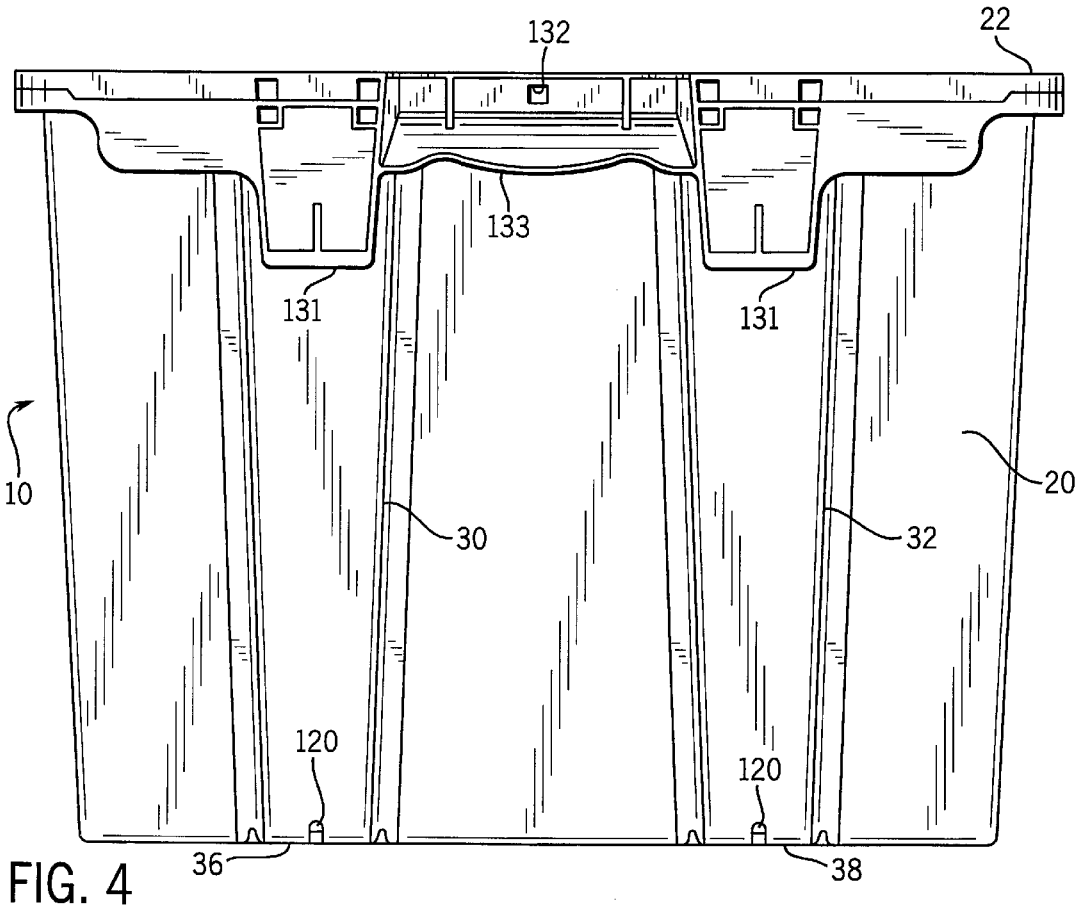
FIG. 4 is an end plan view of the tote box of FIG. 1.
Figure 6:
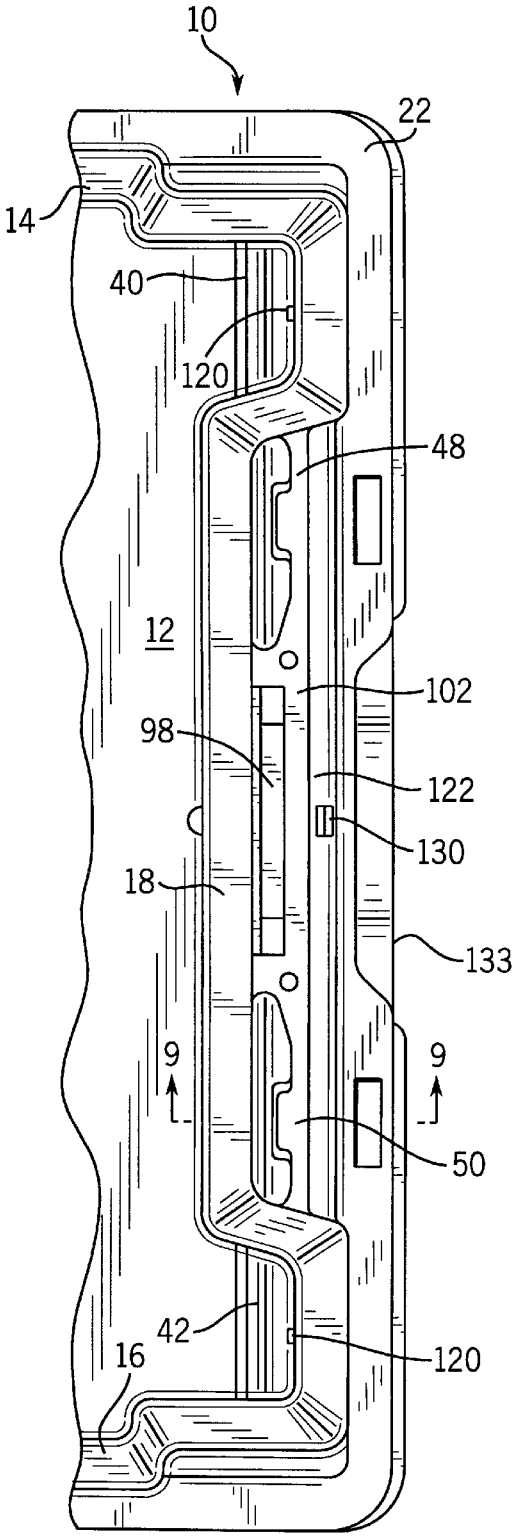
FIG. 6 is a view similar to FIG. 5, but of the opposite end of the box (i.e., the left end as viewed in FIG. 1)
Figure 5:
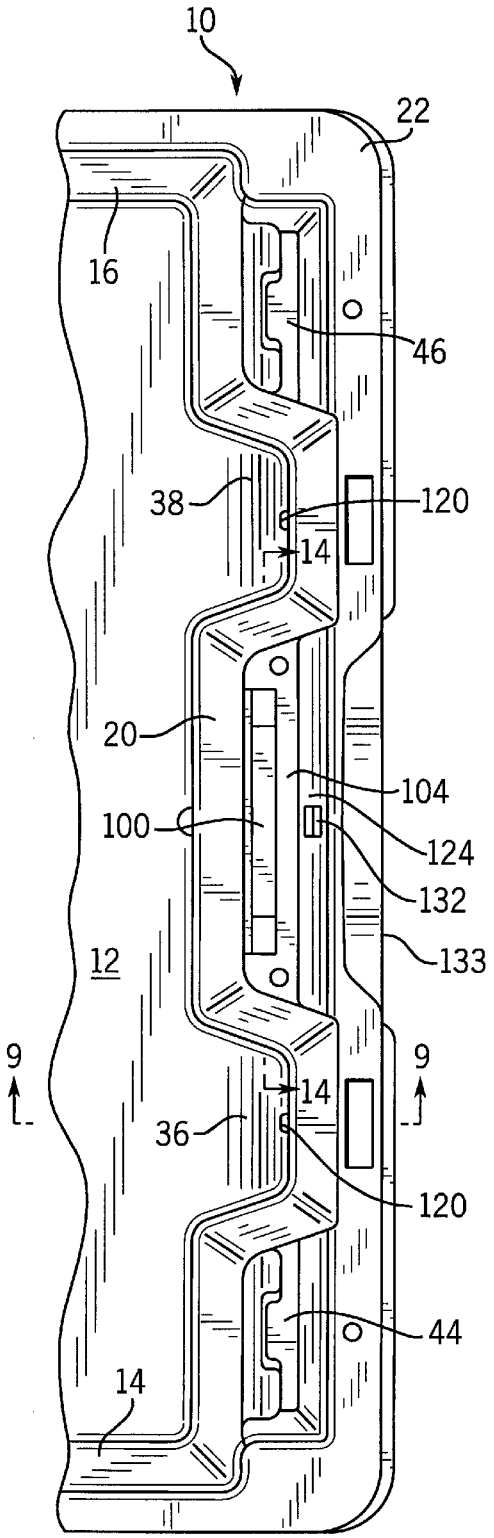
FIG. 5 is a fragmentary top plan view of the end of the box shown in FIG. 4.

As is conventional, all of the walls 14, 16, 18, and 20 taper outwardly at a certain draft angle from the bottom 12 up so that one box 10 can be nested inside another box 10 in one orientation of the boxes relative to one another as shown in FIG. 2. In an orientation of the two boxes which is 180° to that orientation, an upper box 10 can be stacked on a lower box 10 as shown in FIG. 3.

Each end of the box 10 has foot supports formed in the bottom wall 12. At the end of wall 20, these foot supports are indicated at 36 and 38 and at the end of wall 20 the foot supports are indicated at 40 and 42. The structure of the foot supports 36, 38, 40, and 42 are all substantially the same and as illustrated in detail in FIGS. 9–13.

Each end of the box 10 is also provided with ledge supports 44, 46, 48, and 50 which support the respective foot supports 42, 40, 38, and 36 when one box 10 is stacked on top of a lower box 10 in the stacked orientation, so that the foot 42 of the upper box lines up with the ledge 44 of the lower box, foot 40 of the upper box lines up with ledge 46 of the lower box, foot 38 of the upper box lines up with ledge 48 of the lower box, and foot 36 of the upper box lines up with ledge 50 of the lower box.

The foot and ledge supports 36, 38, 40, 42, 44, 46, 48, and 50 will be described with respect to the foot 36 and ledge 50, it being understood that the structure of the foot 36 is essentially identical to the structure of the other feet 38, 40, and 42 and that the structure of the ledge 50 is essentially identical to the other ledges 44, 46, and 48.

Referring particularly to FIGS. 9–13, each foot support has a top wall 54, a bottom wall 56, an inward side wall 58, and an outward side wall 60. The inward side wall 58 is preferably joined to the main bottom wall 12 in a radius and is joined to the top wall 54 in a radius, and the wall 54 is joined to the side wall 60 in a radius. Wall 58 is also tapered so as to guide engagement between the foot support and the ledge support on the lower box 10.

The outer side wall 60 is defined by angled surfaces 60A and 60B and a protrusion 62 which extends inwardly from the angled surfaces 60A and 60B and is defined by a generally horizontal portion of the bottom surface 56 and by a vertical surface 60C which extends laterally. The protrusion 62 also has end surfaces 60D and 60E which are generally vertical and extend longitudinally of the box 10.

Each ledge support, like the support 50 shown, has a bottom wall 68 which is joined at its ends by an outward wall 70 and by an inward wall 72. The wall 70 is angled upwardly and outwardly so as to guide reception of the foot support 36 of an upper box 10. The wall 72 is defined by angled surfaces 72A and 72B and by a recess 74 which defines a generally vertical, laterally extending portion 72C of the inward wall 72 and also end walls 72D and 72E which are generally vertical and extend longitudinally.

When a foot portion is engaged with a ledge portion, the angled surfaces 60A and 60B confront respectively the angled surfaces 72A and 72B to help guide the foot and ledge into engagement with the supports resting on one another, and the vertical surface 72C confronts the vertical surface 60C. In addition, the vertical surfaces 60D and 60E confront the respective vertical surfaces 72D and 72E. This engagement of the protrusion 62 and the recess 74 resists disengagement of the foot supports from the ledge supports when heavy loads are placed on the boxes 10, from the weight contained within the boxes 10, and also the weight of a stack of boxes 10, to increase the load carrying and stacking capacity of the box 10.

Another feature of the invention is orientation indicators 80 which are easily visible from the top and both sides of the box 10 to give a quick visual indication of the orientation the box 10 is in. Thus, by glancing at the indicators 80, which preferably are a color of plastic in contrast to the color of the main body of the box 10, a person can see if the box 10 is oriented to be stacked on top of a lower box or nested within it.

Figure 7:
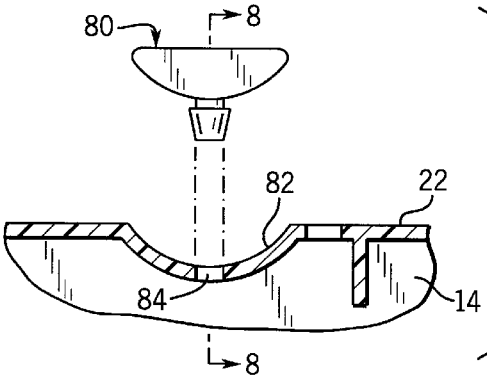
FIG. 7 is a partial sectional view of an orientation indicator exploded away from its assembled position in the top edge of the box of FIG. 1.
Figure 8:
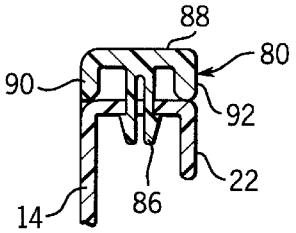
FIG. 8 is a partial sectional view as viewed along the plane of the line 8—8 of FIG. 7.
Figure 9:
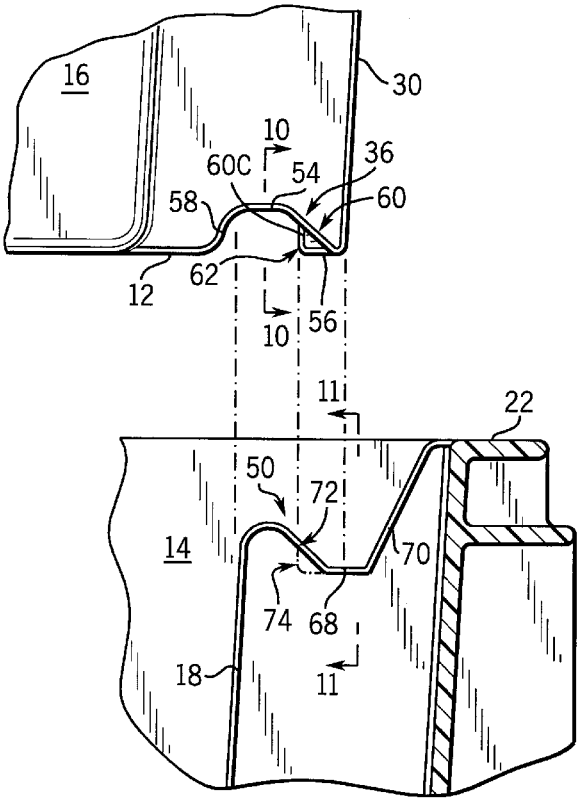
FIG. 9 is a partial sectional exploded view from the plane of the line 9—9 of FIGS. 5 and 6 illustrating how a foot support of an upper box is engaged by a ledge support of a lower box.
Figure 10:
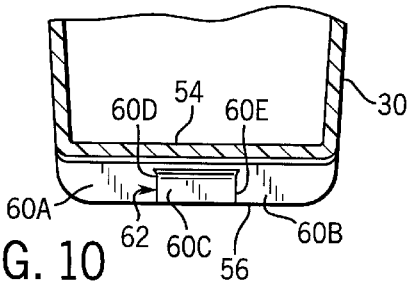
FIG. 10 is a partial sectional view as viewed along the plane of the line 10—10 of FIG. 9.
Figure 11:
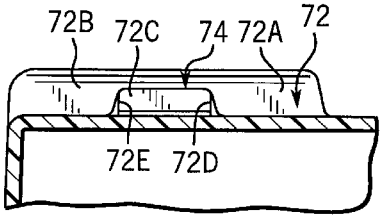
FIG. 11 is a partial sectional view as viewed along the plane of the line 11—11 of FIG. 9.

Each indicator or button 80 is of the form shown in FIGS. 7 and 8. An arcuate recess 82 is formed in the rim 22 at each side of the box, and the recesses 82 are laterally opposite from one another. A hole 84 is formed in each recess 82 into which a split barbed pin 86 of the button 80 can be snapped to secure the button 80 in the recess 82. The button 80 has a top wall 88 and inner and outer side walls 90 and 92, respectively, so that it is easily visible from the top, both sides, and the ends of the box 10, and any angle in between.

The ends of the box 10 are also each provided with a drainage collector 98 at end 18 and 100 at end 20. The collector 98 is provided in a support wall 102 which connects the ledge supports 48 and 50 at the level of the bottom walls 68 of the ledge supports 48 and 50. The collector 100 is provided in a support wall 104 which does not connect the ledge supports 44 and 46, but is at the level of the bottom walls 68 of the ledge supports 44 and 46. The support walls 102 and 104 help support an upper box 10 on a lower box 10 when the upper box 10 is being slid laterally onto the top of the lower box 10 for stacking.

Figure 14:
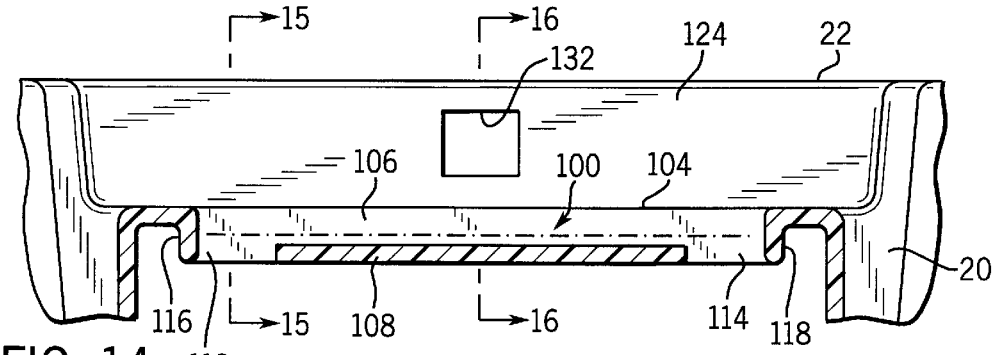
FIG. 14 is a cross-sectional view as viewed from the plane of the line 14—14 of FIG. 5.
Figure 15:
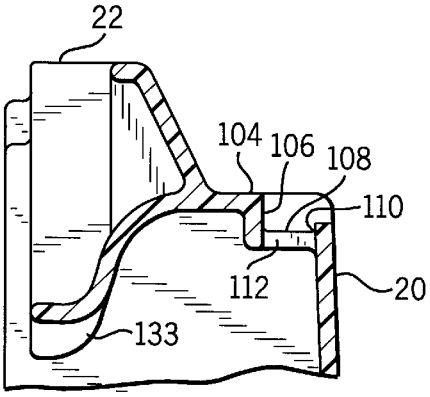
FIG. 15 is a cross-sectional view as viewed from the plane of the line 15—15 of FIG. 14.
Figure 16:
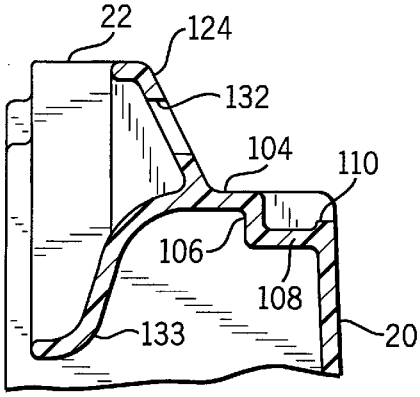
FIG. 16 is a cross-section view from the plane of the line 16—16 of FIG. 14.
Figure 17:
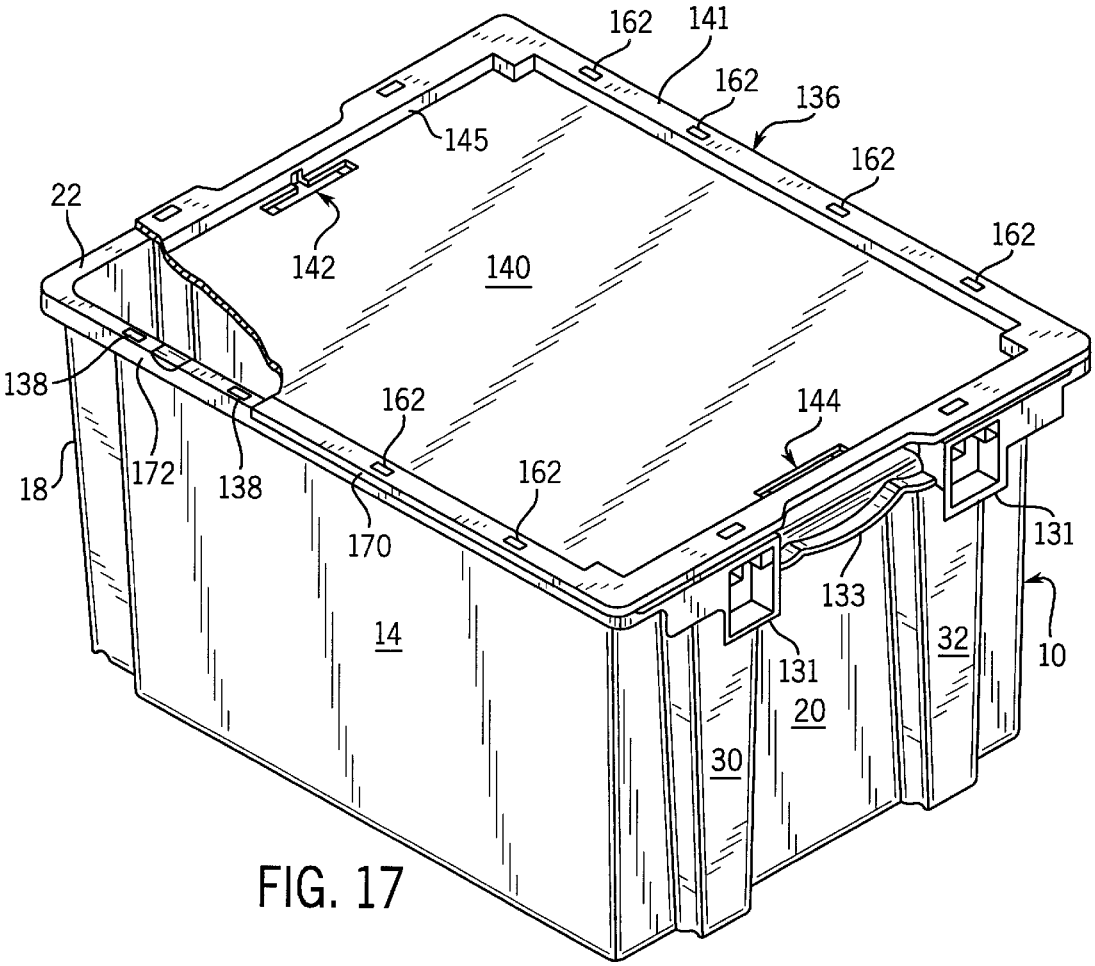
FIG. 17 is a perspective view similar to FIG. 1, but of a second embodiment of a box incorporating the invention which has a one-piece lid.
Figure 19:
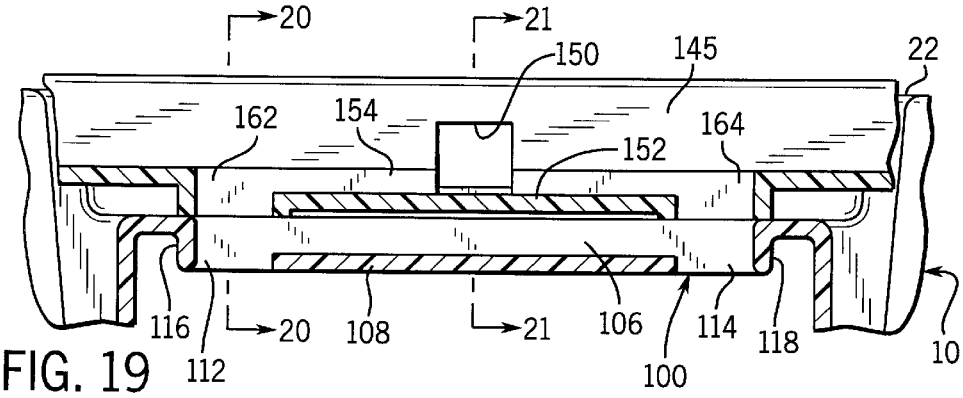
FIG. 19 is a cross-sectional view from the plane of the line 19—19 of FIG. 18.
Figure 18:
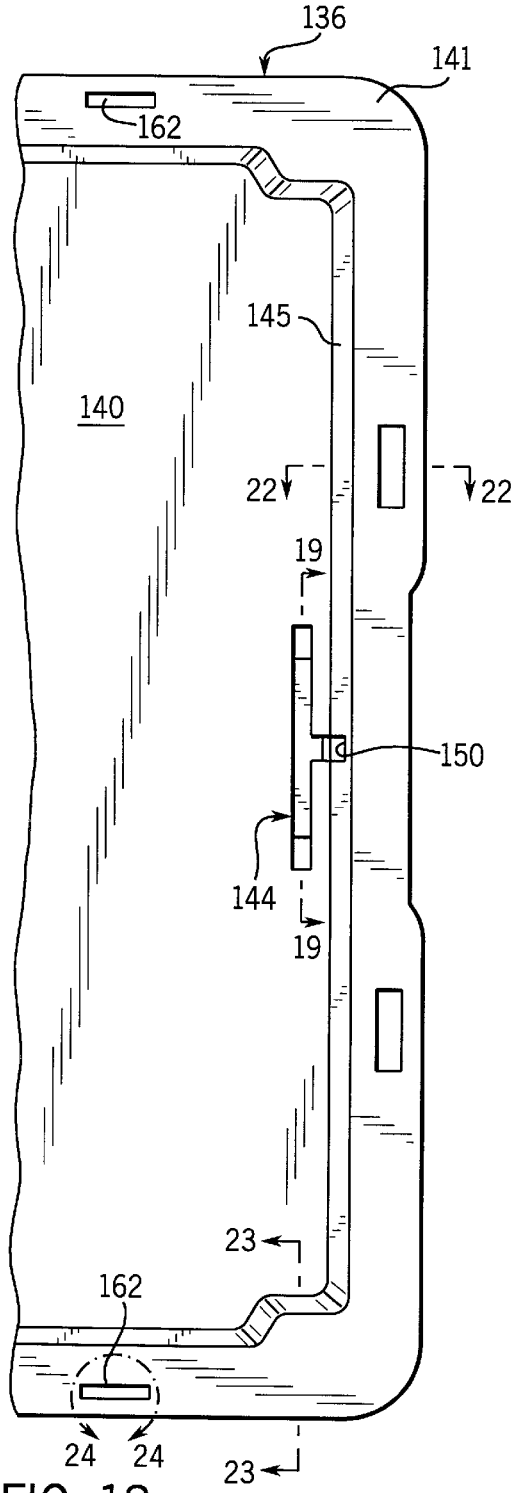
FIG. 18 is a top plan view of one end of the lid.
Figure 20:
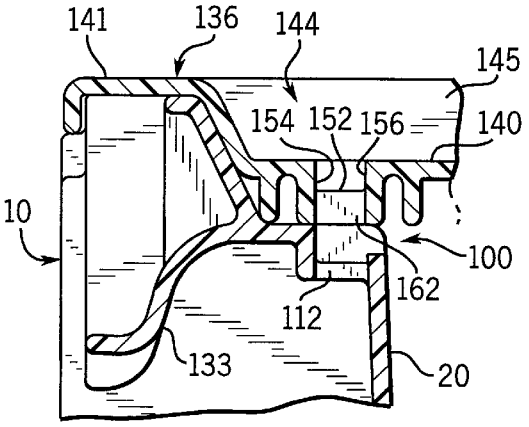
FIG. 20 is a cross-sectional view from the plane of the line 20—20 of FIG. 19.
Figure 21:
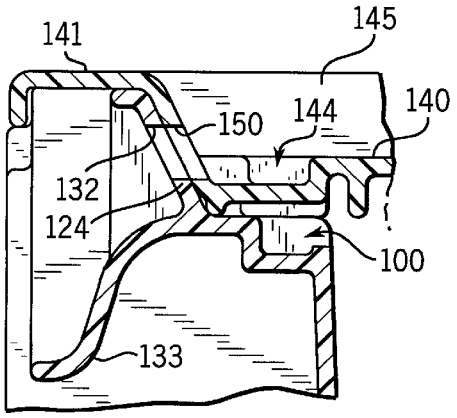
FIG. 21 is a cross-sectional view from the plane of the line 21—21 of FIG. 19.

The drainage collectors 98 and 100 are of identical construction and will be described specifically with respect to the collector 100 shown in FIGS. 14–16. The collector 100 is a recess in the support wall 104 and has an outward laterally running wall 106, a bottom wall 108, and an inward wall 110 which rises above the bottom wall 108 but is substantially shorter than the outer wall 106. The wall 110 is just high enough to keep fluid collecting on the bottom wall 108 from entering the inside of the box 10, instead diverting it to either end of the collector 100 so as to flow through holes 112 and 114 which are provided through the bottom wall 108 at the ends of the collector 100. The collector 100 also has end walls 116 and 118 which connect the outer wall 106 and the inner wall 110. The holes 112 and 114 open to the exterior surface of the end wall 20. The holes 112 and 114 in the collector 98 open downwardly to the exterior of the end wall 18.

Figure 12:
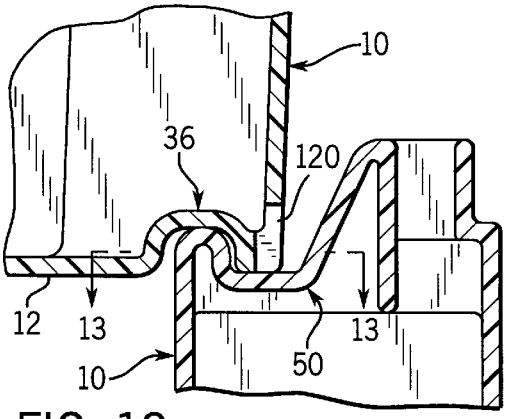
FIG. 12 is a partial sectional view through the longitudinal center of a foot support of an upper box engaged with a ledge support of a lower box.
Figure 13:
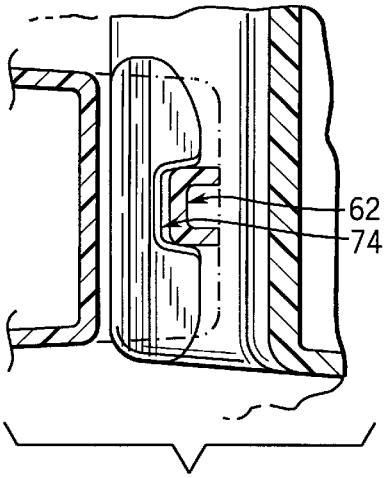
FIG. 13 is a sectional view along the plane of the line 13—13 of FIG. 12.

Drainage holes are provided in the bottom 12 of the box 10 and in the vicinity of each foot support as indicated at 120 (FIG. 12). In a stack of boxes 10, drainage through the holes 120 is eventually directed to one of the collectors 98 or 100 to be directed down the stack along the outside end walls of the boxes 10.

It is also noted that a slanted wall 122 or 124 extends upwardly from the respective support surface 102 or 104 to join the support surface with the rim 22. The wall 122 is at approximately the same angle and lined up with the outward angled walls 70 of the ledge supports 48 and 50 and the angled wall 124 is laterally aligned with and at the same angle as the outer angled walls of the ledge supports 44 and 46. This not only helps guide and support an upper box 10 as it is slid laterally across a lower box 10 into a stacked position in which the foot and ledge supports of the upper and lower boxes are engaged with one another, but also increases the area available for a locking hole 130, 132 through which to put a padlock in order to secure a lid on the box 10.

It is also noted that at the midpoints of the end walls 18 and 20, a handle 133 which conforms arcuately to the fingers of a person carrying the box 10 using both hands on the ends is formed. The handles 133 are best shown in FIGS. 1, 4, 15, and 16. Nesting stops 131 are provided on each side of each handle 133, one at each lateral location of the respective foot supports 36, 38, 40, 42, which rest against the rim of the lower box when nesting the boxes 10.

FIGS. 17–27 illustrate a tote box 10 which is essentially identical to the tote box 10 described above but which is provided with a one-piece lid which is secured to the top of the box 10 through holes 138 in the rim 22. The lid 136 has a recessed central area 140, a raised peripheral edge 141 and also is molded plastic, e.g., polypropylene. Peripheral angled wall 145 connects area 140 and edge 141. At each end of the lid 136, in the recessed area 140 and above the respective collectors 98 and 100, a lid collector 142, 144 is formed which is of similar construction to the respective collectors 98 and 100. Each lid collector 142, 144 collects drainage on top of the lid 136 and directs it down to the respective collectors 98 and 100 to be directed to the exterior of the box 10. The structure of the collectors 142 and 144 is identical and will be described with reference to the collector 144 illustrated in FIGS. 19–22.

Each lid collector is generally T-shaped with a long leg which corresponds and is aligned with the collector 98 or 100 beneath it and a short leg which extends over to a lock hole 150 which is formed in an angled peripheral wall which joins the recessed area 140 to the raised edge 141. The lock hole 150 in angled wall 145 is aligned with the respective lock hole 130 or 132 when the lid 136 is assembled to the box 10, for insertion of the shank of a padlock therethrough to secure the lid 136 to the main body of the box 10. Like the collectors 98 or 100 beneath them, each collector 142, 144 has a bottom wall 152, an outer side wall 154, an inner side wall 156, holes 158 and 160 at the ends which extend through the bottom wall 152, and end walls 162 and 164 which connect the outer wall 154 and the inner wall 156. The holes 162 and 164 are aligned with the holes 112 and 114 in the collector 98 or 100 beneath the respective collector 142 or 144.

Thereby, fluid collected on top of the lid 140 is directed to the exterior of the box beneath it, which when the boxes are stacked with one box 10 on top of the lid 140 of the box 10 beneath it, results in drainage flowing down the exterior of the end walls of the stack.

The lid 140 is attached to the box 10 by means of snap fasteners as illustrated in FIGS. 23–27, which are integrally-molded in the peripheral edge 141 of the lid 140 and extend through holes 138 in the rim 22 of the box 10 to engage beneath the rim 22. The edge 141 is integrally formed with connector structures, one of which is shown in detail in FIGS. 23–27. All of these connector structures 160 are identical to one another. Each connector structure is formed with a hole 162 through the edge 141 and a wall 164 which depends downwardly from the edge 141 at the inner side of the hole 162. At the bottom of the wall 164, a laterally outwardly extending wedge 166 is formed. The wedge 166 has upwardly and downwardly facing angled surfaces for camming the wedge 166 down into the hole 138 to engage the lid with the box 10 and for camming the wedge 166 upwardly through the hole 138 for disengaging the lid from the box 10.

The edge 141 has a downwardly extending peripheral lip 170 which overlaps down over the outside of peripheral flange 172 of the rim 22. The distance from the inner surface 171 of lip 170 to the tip 174 of the wedge 166 is preferably slightly less than the distance from the outer surface 173 of flange 172 to the nose 176 on the outer side of hole 138. Thus, for wedge 166 to enter and exit the hole 138, the wall 164 and flange 170 must flex somewhat, which causes a resilient secured engagement between the lid 140 and the box 10.

As best shown in FIGS. 24 and 25, one end of the wedge 166 is preferably tapered inwardly as shown at 178 so as to smoothly start camming in and camming out of the wedge 166 from the hole 138. In the preferred embodiment the opposite end is shown squared off, but it also could be curved inwardly. In the preferred embodiment, the curved or tapered ends 178 are on the longitudinal outside of the wedges 166. In other words, the curved ends 178 of the four wedges 166 to the right (as viewed in FIG. 17, two on each side 14 and 16) of the longitudinal central plane of the box 10 face end wall 20 and the curved ends 178 of the four wedges 166 (two of which are broken away in FIG. 17) to the left of the longitudinal central plane face end 18.

The lid 140 is engaged with the box 10 by simply pushing down on the edge 141 until the wedges 166 are engaged beneath the rim 22 and is removed from the box 10 by pulling up on one end of the lid 140.

FIGS. 28–35 illustrate a third embodiment of a tote box 10 of the invention which is essentially identical to the first embodiment described except that it is provided with a two-piece hinged lid 200. The two pieces 202, 204 of the lid 200 are molded plastic, e.g., polypropylene. Each piece 202, 204 is hinged with a piano-type hinge 214 along the top of the adjacent respective side wall 16 or 14.

Each piece 202, 204 meets with the other piece in the middle of the box 10 along a longitudinal line of closure 206.

The lid pieces 202, 204 are identical and are locked together along the line of closure 206 with engagement structures of any suitable construction. For example, one possible construction is as disclosed in U.S. Pat. No. 4,432,467, which is commonly owned with the present invention and is hereby incorporated by reference.

In addition to such engagement structures, the present invention incorporates a flow channel 216 in each piece 202, 204. The two flow channels 216, each of which runs from approximately the center of the lid longitudinally to the outside, channel fluid on top of the lid 200 which flows into the nip 218 between the two pieces 202, 206 over to the collectors 98, 100 which are at the respective ends of the box 10.

Figure 31:
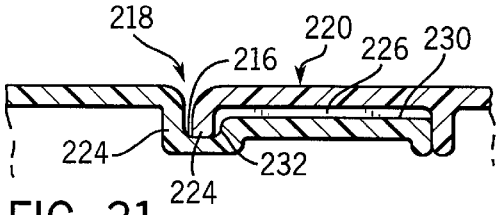
FIG. 31 is a cross-sectional view from the plane of the line 31—31 of FIG. 29.
Figure 32:
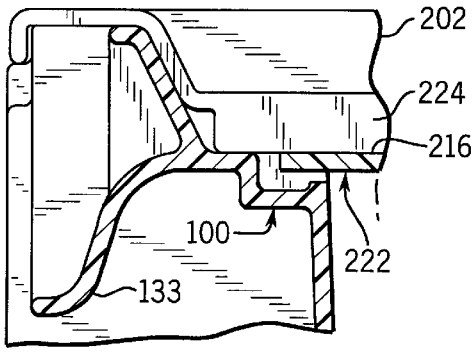
FIG. 32 is a cross-sectional view from the plane of the line 32—32 of FIG. 30.

As is common and known from U.S. Pat. No. 4,432,467, each piece 202, 204 has an overlapping flap 220 which extends beyond the line of closure 206 and an underlapping shelf 222 which extends up to the line of closure 206. The flap has rib structures (FIG. 28B) on its underside similar to those disclosed in U.S. Pat. No. 4,432,467, except that the flange 224, which runs along the outer edge of the flap 220 and along the inner edge of the shelf 222, is taller than the lateral ribs 226 (See FIG. 31, comparing flange 224 of flap 220 to rib 226). Also, since only four box-like engaging structures 228 are provided on the shelf 222, the lateral ribs 226 are spaced and provided in number so as to receive the four structures 228.

The structures 228 are elevated above the bottom of channel 216 by island 230, the inside vertical wall 232 of which forms the outer wall of the channel 216 rising up from the bottom of the channel 216. The structures 228 have longitudinally running walls that are aligned and coterminous with the longitudinally running walls 232 and 233 of the island 230. Flange 224 of the overlying flap 220 comes down into the channel 216 over the inside vertical walls of the structures 228 as well as the inside vertical wall 232 of the island 230. The opposite wall of the channel 216 is formed by the portion of flange 224 which runs along the shelf 222 (FIG. 31). A longitudinally running rib 236 joins the inner end of island 230 with flange 224 to dam water in the channel 216, so as to keep it from flowing into the box 10 past the inside end of the channel 216. A notch 238 is formed in the flange 224 of each piece 202, 204 to accommodate the rib 236 of the other piece 202, 204 when the lid 200 is closed. Thus, the only zone along the line of closure 206 at which flow from the lid can enter the box 10 is in the area indicated at 240 (FIG. 28A), between the flanges 224 of the two pieces 202, 204, where they cross the line of closure 206 and there is a small space down into the box 10.

At the outer end of each channel 216, the channel is open (not blocked by a dam-like rib 236) and permits flow down into the adjacent underlying collector 98 or 100 (FIG. 32), to be directed down the outside of the box 10 as described above.

Figure 28A:
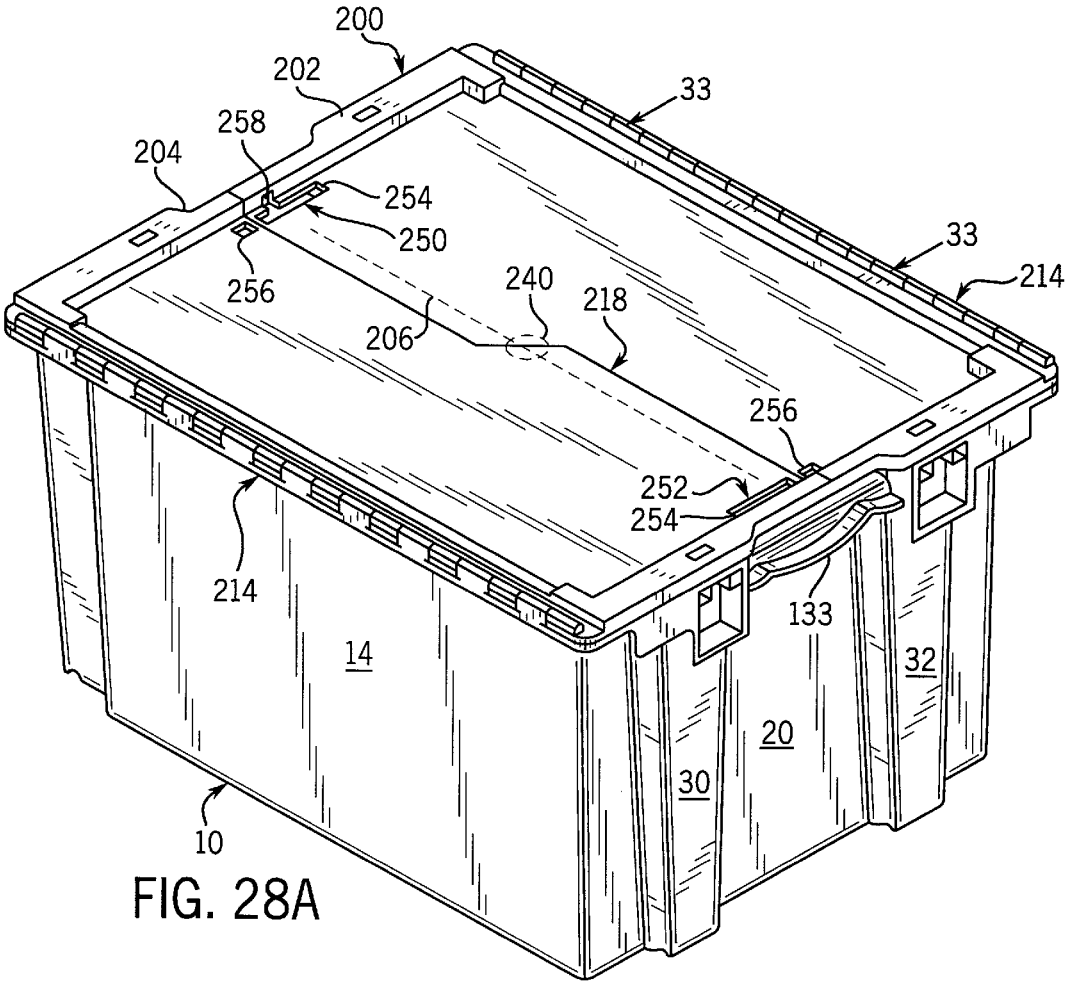
FIG. 28A is a perspective view similar to FIG. 17 but of a third embodiment of a box incorporating a two-piece hinged lid, with the lid closed.
Figure 30:
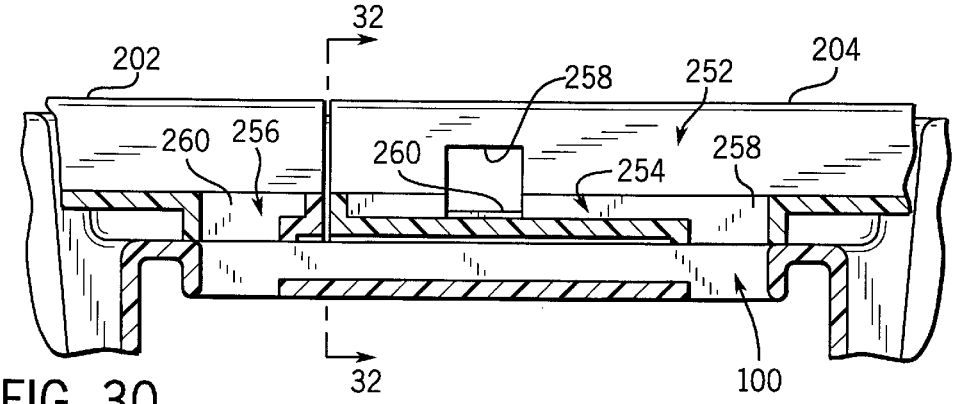
FIG. 30 is a cross-sectional view from the plane of the line 30—30 of FIG. 29.
Figure 28B:
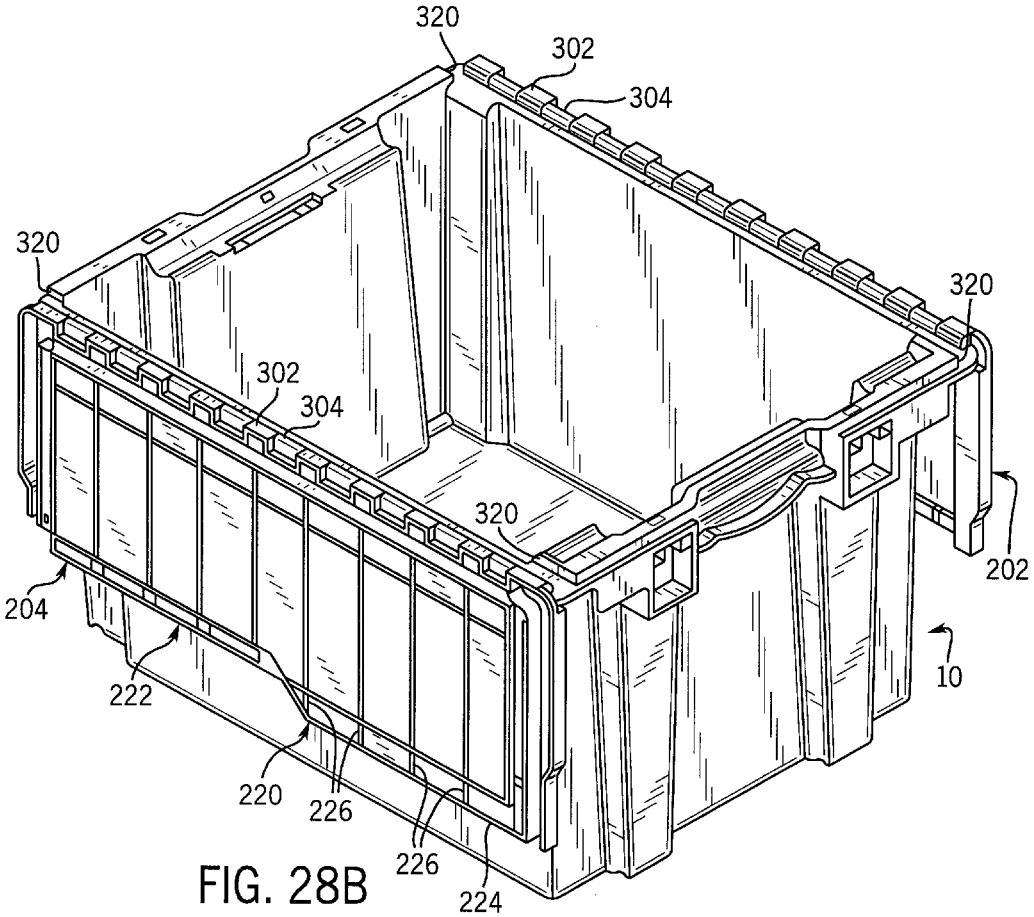
FIG. 28B is a perspective view of the box of FIG. 28A but with the lid open.
Figure 35B:
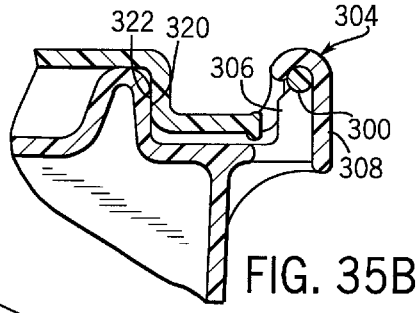
FIG. 35B is a cross-sectional view from the plane of the line 35B—35B of FIG. 29.
Figure 28C:
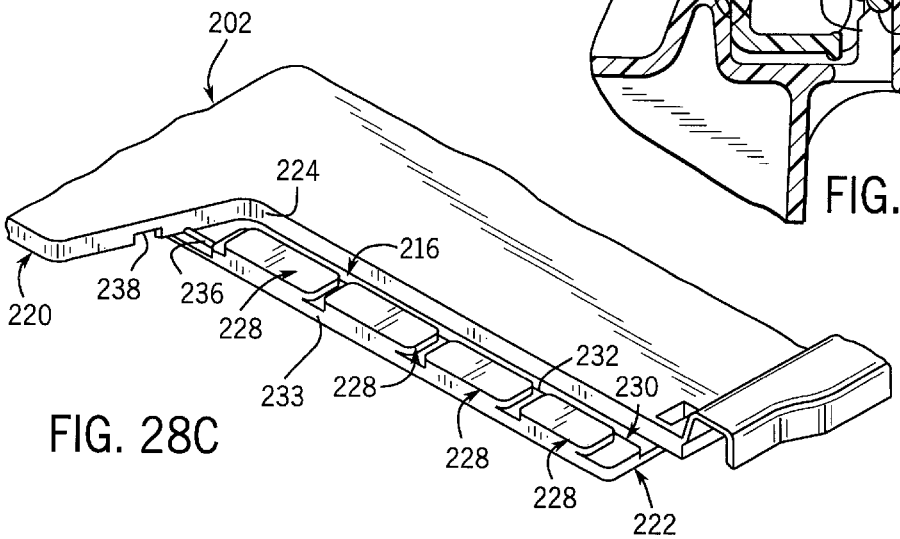
FIG. 28C is a detail perspective view of a portion of the inner edge of one of the pieces of the lid of FIG. 28A illustrating a shelf of the piece.
Figure 29:
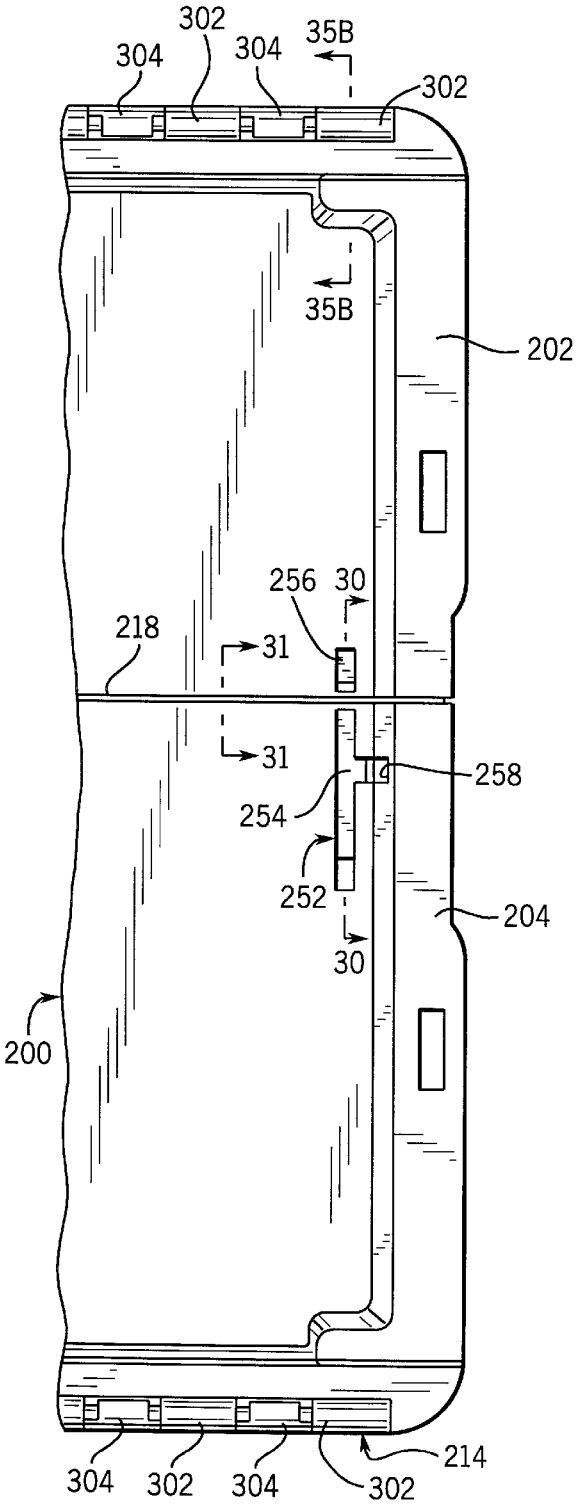
FIG. 29 is a top plan view of one end of the lid of FIG. 28A.

The pieces 202, 204 when closed provide lid collectors 250, 252, as shown in FIGS. 28A, 29, and 30. Each lid collector is provided by a recess 254 in one of the lid pieces 202, 204 and by a recess 256 in the other piece 202, 204. The recesses 254, 256 have respective holes 258, 260 in their bottoms which channel liquid down into the adjacent collector 98, 100, to be directed to the outside of the box 10. The recess 254 also extends longitudinally to a lock hole 258 which is aligned with hole 132 in the adjacent end of the box 10 when the lid is closed, which permits making the hole 258 larger. Also, hole 258 is elevated above the bottom of recess 254 by rib 260, which directs liquid to the hole 258 rather than out through the lock hole 258.

Figure 33:
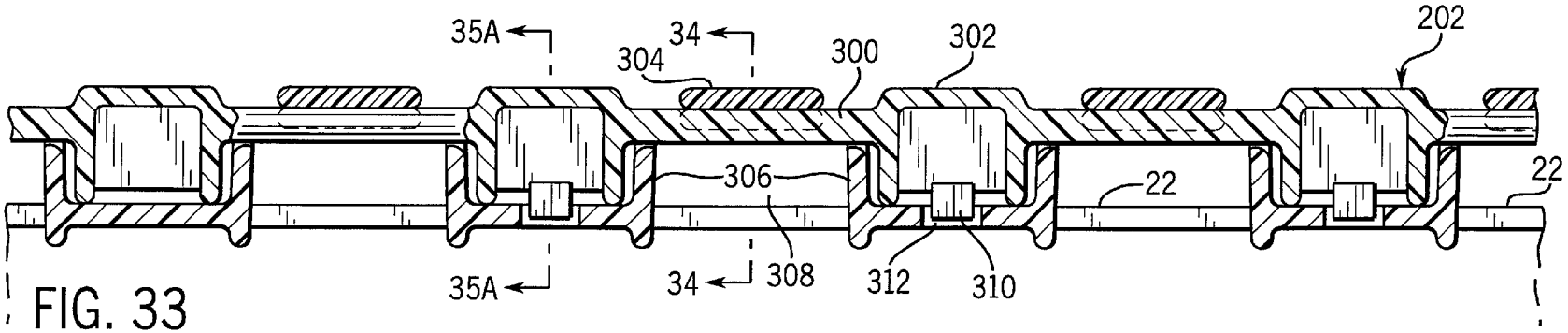
FIG. 33 is a cross-sectional view from the plane of the line 33—33 of FIG. 28A.
Figure 35A:
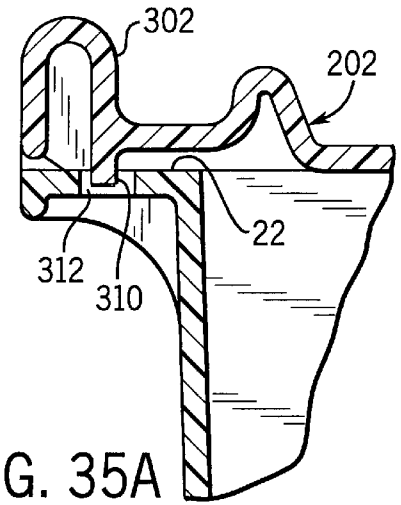
FIG. 35A is a cross-sectional view from the plane of the line 35A—35A of FIG. 33.
Figure 34:
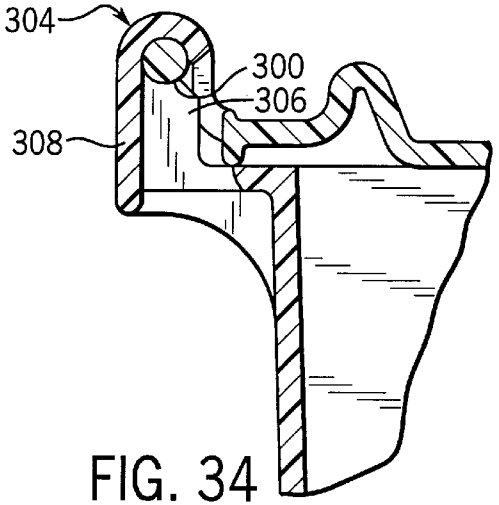
FIG. 34 is a cross-sectional view from the plane of the line 34—34 of FIG. 33.
Figure 36:
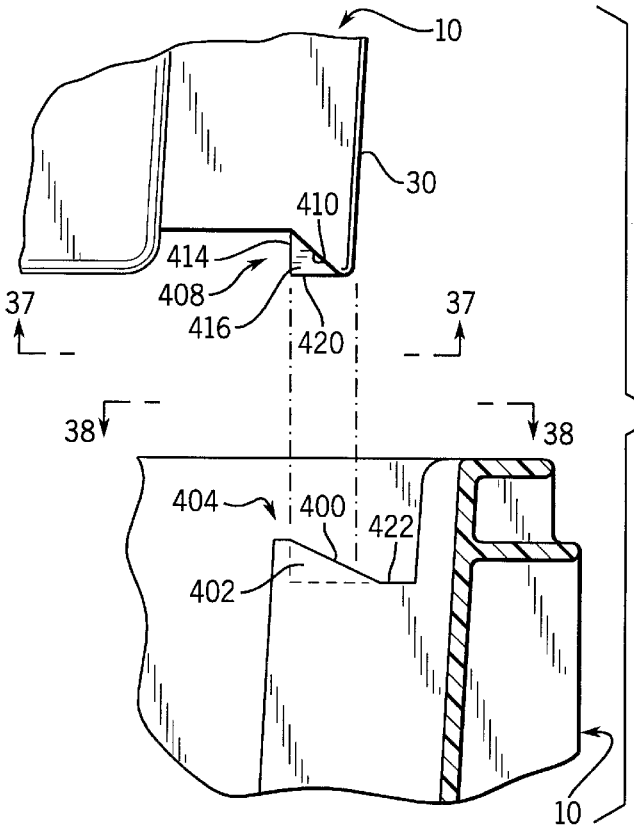
FIG. 36 is a view similar to FIG. 9 but of a foot support and ledge support of a fourth embodiment of a tote box incorporating the invention.
Figure 37:
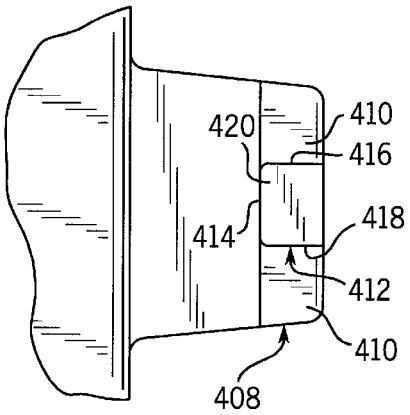
FIG. 37 is a plan view from the plane of the line 37—37 of FIG. 36.
Figure 38:
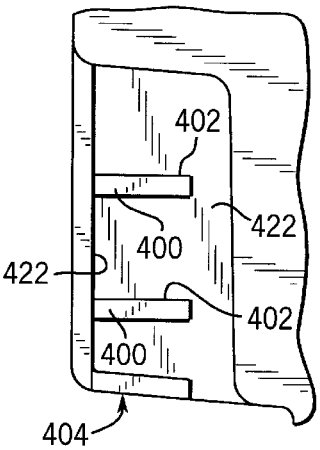
FIG. 38 is a plan view from the plane of the line 38—38 of FIG. 36.
Figure 39:
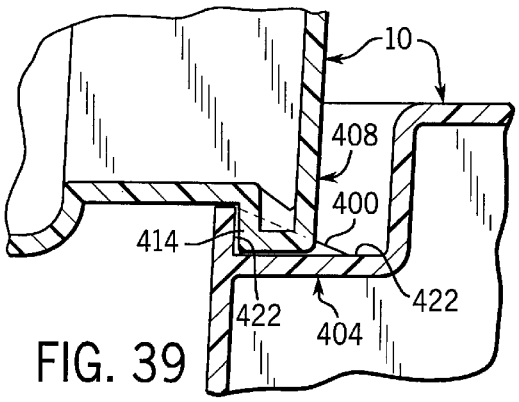
FIG. 39 is a cross-sectional view similar to FIG. 12 but showing the foot support and ledge support of FIG. 36.

FIG. 33–35 illustrate aspects of the piano-type hinge 214 which form part of the present invention. Hinge pins 300 are integrally molded with each piece 202, 204 and extend longitudinally between pin supports 302, which are integrally molded with the adjacent pins 300 and with the outer longitudinally running edge of the corresponding piece 202, 204. Upstanding, inwardly opening hooks 304 are molded integrally with the upper longitudinally running edge of the box 10, and a laterally extending end wall 306 is molded integrally at each end of each longitudinally running vertical wall 308, the upper end of which defines the hook 304. The upper ends of the walls 306 are formed with an upwardly facing radius so as to cradle the hinge pins 300, and the hooks 304 snap over the adjacent pins 300 so as to secure the hinge connection between the box 10 and each piece 202, 204.

Preferably, to improve the security of the box 10 when the lid 200 is locked closed, the middle four or so of the pin supports 302 have downwardly extending tabs 310 (FIGS. 33 and 35A) molded integrally with them which extend into holes 312 formed in the rim 22 of the box 10 when the lid 200 is closed. The tabs 310 are long enough to extend into the holes 312 when the lid is shut, but short enough not to hinder swinging the lid pieces 202, 204 open and closed. Thus, the engagement of the tabs 310 in the holes 312 resists separation of the hinge joint by a potential pilferer trying to pull the top edge of the box 10 laterally away from the outer edge of the lid 200. On the other hand, each lid piece 202, 204 can be removed from the box 10 by first swinging it up to move the tabs 310 out of the holes 312, before then disengaging the hinge pins 300 from between the hooks 304 and walls 306.

Another feature which enhances the security of the box 10 is the formation of a longitudinally extending outwardly facing wall 320 (FIGS. 28B and 35B) on the upper edge of the box 10 at each corner and a corresponding longitudinally extending inwardly facing wall 322 on the lower side of each lid piece 202, 204 at each outer corner thereof which faces in close proximity or abuts the wall 320 on the box 10. These walls are preferably provided in close proximity to the hinges 214, since, like the tabs 310 and holes 312, they serve the purpose of resisting lateral separation of the hinge joint when the lid 200 is closed.

An alternate embodiment of foot and ledge supports of the invention is illustrated in FIGS. 36–39. In this embodiment, a combination of vertical and angled surfaces is also used as in the first embodiment, although in a different construction. In the embodiment shown in FIGS. 36–39, the angled surfaces 400 of the ledge supports 404 are provided on the exposed edges of gussets 402 and the angled surfaces of foot supports 408 are provided by angled walls 410 which extend on both sides of a protrusion 412 which presents a laterally extending vertical wall 414, longitudinally extending triangular shaped end walls 416 and 418, and a horizontal bottom wall 420, very similar to the foot supports of the first embodiment of FIGS. 9 and 10. Laterally extending vertical wall 422 of each ledge support 404 is between the gussets 402 and confronts wall 414 when the boxes are stacked. Longitudinally extending generally triangular end walls 416 and 418 confronting the inside surfaces of the gussets 402, the angled surfaces 400 confronting the angled walls 410 in the area adjacent to the protrusion 412, and the bottom wall 420 rests on the bottom wall 422 of the ledge support 404 when boxes are stacked. This combination of confronting angled and vertical surfaces also helps guide stacked boxes into position and engagement when they are stacked and resists collapse of the stack when it is heavily loaded or of boxes within the stack when they are heavily loaded.

Preferred embodiments of the invention have been described in considerable detail. Many modifications and variations of the preferred embodiments described will be apparent to those skilled in the art which incorporate the invention. Therefore, the invention should not be limited to the embodiments described, but should be defined by the claims which follow.

We claim:

1. In a stackable plastic tote box of the type having foot supports at a bottom of said box and ledge supports near a top of said box, said ledge supports of a lower box being for receiving said foot supports of en upper box to support said upper box on said lower box in vertical stacked relation, the improvement wherein:

said ledge supports and said foot supports each have laterally extending confronting angled and vertical surfaces, said angled and vertical surfaces of each said foot support facing inwardly and said angled and vertical surfaces of each said ledge support facing outwardly, one support of a pair of said supports which mate in confrontation with one another which said pair includes one foot support and one ledge support, having said vertical surface provided in a recess within said angled surface of said one support and the other of said pair of mating supports having said vertical surface raised from said angled surface of said other support so as to be received in said recess so that said vertical surfaces confront one another within said recess and said angled surfaces of said pair of mating supports confront one another outside of said recess.

2. The improvement of claim 1, wherein said angled surface of each of said supports of said pair of mating supports extends laterally to each side of said vertical surface of the corresponding support.

3. The improvement of claim 1, wherein said angled surface is formed on said ledge supports on at least one gusset.

4. The improvement of claim 1, wherein an inwardly facing angled surface is formed on said ledge support opposite from said outwardly facing vertical and angled surfaces.

5. The improvement of claim 1, wherein said supports are arranged differently from one end of the box to the other such that in a first orientation of the upper box relative to the lower box the boxes stack, and in a second orientation 180° to the first orientation the boxes nest.

6. The improvement of claim 5, wherein at one end of said box, said ledge supports are joined by a support surface at approximately the same level as said ledge supports and at said opposite end of said box a support surface is provided between and spaced inwardly from said ledge supports.

7. The improvement of claim 1, wherein said supports further comprise confronting longitudinally extending vertical surfaces which, in each said support,join said angled surface to said vertical surface of said support.

8. The improvement of claim 1, wherein said recess is formed in said ledge support.

* * * * *